US011021860B1

(12) United States Patent
Thomas

(10) Patent No.: US 11,021,860 B1
(45) Date of Patent: Jun. 1, 2021

(54) TOILET TANK SUPPORT

(71) Applicant: Marvin Thomas, St. Louis, MO (US)

(72) Inventor: Marvin Thomas, St. Louis, MO (US)

( * ) Notice: Subject to any disclaimer, the term of this patent is extended or adjusted under 35 U.S.C. 154(b) by 0 days.

(21) Appl. No.: 16/688,382

(22) Filed: Nov. 19, 2019

(51) Int. Cl.
*E03D 1/012* (2006.01)

(52) U.S. Cl.
CPC ..... *E03D 1/012* (2013.01)

(58) Field of Classification Search
CPC . E03D 1/012; E03D 11/14; E03C 1/32; F16B 5/0635; E06B 1/6069; F16M 13/02
USPC ..... 248/312.1, 216.1, 692, 215, 227.1, 322, 248/351; 4/419, 661, 344; 224/560
See application file for complete search history.

(56) References Cited

U.S. PATENT DOCUMENTS 1,674,305 A * 6/1928 Sedlock ..... G10G 5/00 248/688
2,810,136 A * 10/1957 Kearney ..... E03D 1/26 4/419
3,666,225 A * 5/1972 Weinberger ..... E03D 1/01 248/205.3
D238,461 S * 1/1976 Bauman ..... D6/521
3,952,339 A * 4/1976 Baur ..... E03D 9/038 4/227.6
4,074,872 A * 2/1978 Marshall, Jr. ..... A47K 10/3836 242/597.7
4,203,175 A * 5/1980 Heine ..... A47C 21/00 211/34
4,247,070 A * 1/1981 Dirksing ..... E03D 9/038 248/215
4,376,502 A * 3/1983 Cohen ..... B62B 3/1464 224/411
4,418,496 A * 12/1983 Koistinen ..... A01G 5/04 248/215
4,638,515 A * 1/1987 Caputo ..... A47K 13/245 292/254
4,739,582 A * 4/1988 Cullinane ..... A47G 7/044 47/41.12
4,825,590 A * 5/1989 Cullinane ..... A47G 7/044 248/229.16
5,456,046 A * 10/1995 Vitalune ..... A01G 5/04 248/214
D393,389 S * 4/1998 Thurston-Chartraw ..... D6/520
5,806,108 A 9/1998 Mizrahi
5,966,865 A * 10/1999 Jones ..... A47G 7/044 248/218.4
6,073,899 A * 6/2000 Omrani ..... A47K 10/185 248/311.2
6,641,100 B2 * 11/2003 Furukawa ..... A47K 10/18 248/216.1
6,659,412 B1 * 12/2003 Roach ..... A47G 7/044 211/113
7,845,604 B2 * 12/2010 Connor, Jr. ..... A47F 5/08 211/85.23

(Continued)

*Primary Examiner* — Ingrid M Weinhold
(74) *Attorney, Agent, or Firm* — David H. Chervitz

(57) ABSTRACT

A toilet tank support has a bracket member having an upper hook portion having a front leg portion, an upper horizontal portion, a vertical member, and a lower hook portion having a back leg portion, and a lower horizontal portion connected to the vertical member, and a spacer member having an opening for receiving the back leg portion of the bracket member. A toilet tank support kit also has a bracket member and a number of spacer members packaged together.

19 Claims, 4 Drawing Sheets

(56) References Cited

U.S. PATENT DOCUMENTS

| | | | | |
|---|---|---|---|---|
| 7,887,017 | B2 * | 2/2011 | Moran | B44C 5/00 248/215 |
| 8,896,768 | B1 * | 11/2014 | Wengreen | H05K 5/0204 348/836 |
| 9,528,751 | B2 * | 12/2016 | Sexton | F25D 23/12 |
| 10,081,935 | B2 * | 9/2018 | Beck | E03D 1/012 |
| 10,190,299 | B2 * | 1/2019 | Vadnais | E03D 1/012 |
| 10,435,879 | B1 * | 10/2019 | Orsano | E03D 11/14 |
| 2006/0049124 | A1 * | 3/2006 | Wang | A47B 43/003 211/113 |
| 2007/0000044 | A1 | 1/2007 | Huei | |
| 2008/0245937 | A1 * | 10/2008 | Connor | A47F 5/08 248/215 |
| 2015/0191902 | A1 * | 7/2015 | Vadnais | E03D 1/012 29/428 |
| 2017/0306599 | A1 * | 10/2017 | Beck | E03D 1/012 |
| 2019/0376268 | A1 * | 12/2019 | Orsano | E03D 11/14 |

* cited by examiner

TOILET TANK SUPPORT

BACKGROUND

This disclosure relates generally to a toilet tank support, and more particularly to a toilet tank support that prevents damage to a toilet tank.

Toilets typically consist of three parts which are a toilet tank that holds water for flushing purposes, a toilet bowl having a seat, and a flushing mechanism. In two piece type toilets the toilet tank is secured to the toilet bowl by use of a pair of bolts. The toilet is usually positioned adjacent to a wall. However, sometimes the toilet is not positioned close enough to a wall and there is a gap between the wall and the toilet tank. When an individual is sitting on the seat of the toilet bowl the back of the individual is against the toilet tank. If the individual presses too hard against the toilet tank the bolts may not be strong enough to prevent the toilet tank from becoming loose from the bolts or from the toilet tank being damaged. If the toilet tank becomes loose then water damage can occur as water will leak through bolt holes formed in the toilet tank. Further, it is also possible that the bolts will completely fail and the toilet tank will separate from the toilet bowl. If the bolts fail then it is possible that the toilet tank will press against the wall and damage the wall. In order to prevent this, toilet tank supports are used to bridge the gap between the toilet tank and the adjacent wall. However, such known toilet tank supports require that the support be customized in that the support needs to be cut to a certain length to fill the space between the toilet tank and the wall. Further, such known toilet tank supports do not provide a large contact point or area against wall and due to this are subject to shifting, moving, or falling. Also, known toilet tank supports are rather flimsy in construction and are subject to breaking or failing when in use.

The present disclosure is designed to obviate and overcome many of the disadvantages and shortcomings experienced with prior support devices. Moreover, the present disclosure is related to a toilet tank support that can be easily positioned to span the gap between a toilet tank and a wall without having to cut the support. The toilet tank support of the present disclosure is also simple to use due to the support not requiring any measuring or cutting of the support. Also, the toilet tank support of the present disclosure does not require any tools to install or remove the support.

SUMMARY

In one form of the present disclosure, a toilet tank support is disclosed which comprises a bracket member having an upper hook portion having a front leg portion, an upper horizontal portion, a vertical member, and a lower hook portion having a back leg portion, and a lower horizontal portion connected to the vertical member, and a spacer member having an opening for receiving the back leg portion of the bracket member.

In another form of the present disclosure, a toilet tank support comprises a bracket member having an upper hook portion having a front leg portion, an upper horizontal portion, a vertical member, and a lower hook portion having a back leg portion, and a lower horizontal portion connected to the vertical member, and a spacer member having a front toilet tank engaging surface, a lower side, and a rear wall engaging surface and an opening formed in the lower side for receiving the back leg portion of the bracket member.

In still another form of the present disclosure, a toilet tank support kit is disclosed which comprises a bracket member having an upper hook portion having a front leg portion, an upper horizontal portion, a vertical member, and a lower hook portion having a back leg portion, and a lower horizontal portion connected to the vertical member, a first spacer member having an opening for receiving the back leg portion of the bracket member, the first spacer member having a width, and a second spacer member having an opening for receiving the back leg portion of the bracket member, the second spacer member having a width with the width of the second spacer member being greater than the width of the first spacer member.

In light of the foregoing comments, it will be recognized that the toilet tank support of the present disclosure is of simple construction and design and which can be easily employed with highly reliable results.

The present disclosure provides a toilet tank support that can be easily installed on a toilet tank without using any tools.

The present disclosure provides a toilet tank support that is easy to use and install on a toilet tank and does not interfere with the use of a toilet.

The present disclosure provides a toilet tank support that is lightweight, strong, compact, and durable and prevents a toilet tank from moving once installed on the toilet tank.

The present disclosure also provides a toilet tank support that can be constructed using readily available materials.

The present disclosure is directed to a toilet tank support that provides a large surface area or contact point against a wall so that the toilet tank support will not shift during use and will prevent a toilet tank from wobbling or moving.

The present disclosure also provides a toilet tank support that does not require any measuring to be able to install the toilet tank support on a toilet tank.

The present disclosure is also directed to a toilet tank support that does not require any specialized skills to be able to install or remove the support from a toilet tank.

The present disclosure further provides a toilet tank support that does not have any moving parts and prevents a toilet tank from wobbling or moving when installed on a toilet tank.

The present disclosure is further directed to a toilet tank support that is constructed of a material that is resistant to mold and mildew.

The present disclosure also provides a toilet tank support that does not require any fasteners to attach the toilet tank support to a wall.

The present disclosure is also directed to a toilet tank support kit which has a bracket member and a number of spacer members packaged together so that various width spaces or gaps between a toilet tank and a wall may be accommodated.

The present disclosure provides a toilet tank support kit which has a bracket and a number of different width spacer members so that no prior measurement of a space or gap between a toilet tank and a wall is required.

The present disclosure is also directed to a toilet tank kit which is of simple construction and design and which can be easily employed with highly reliable and desirable results.

The present disclosure also provides a toilet tank kit which easy to install on a toilet tank without the use of any tools.

The present disclosure also provides a toilet tank support kit that does not require any fasteners to attach the toilet tank support kit to a wall.

These and other advantages of the present disclosure will become apparent after considering the following detailed specification in conjunction with the accompanying drawings, wherein:

DETAILED DESCRIPTION OF A PREFERRED EMBODIMENT

Figure 1:
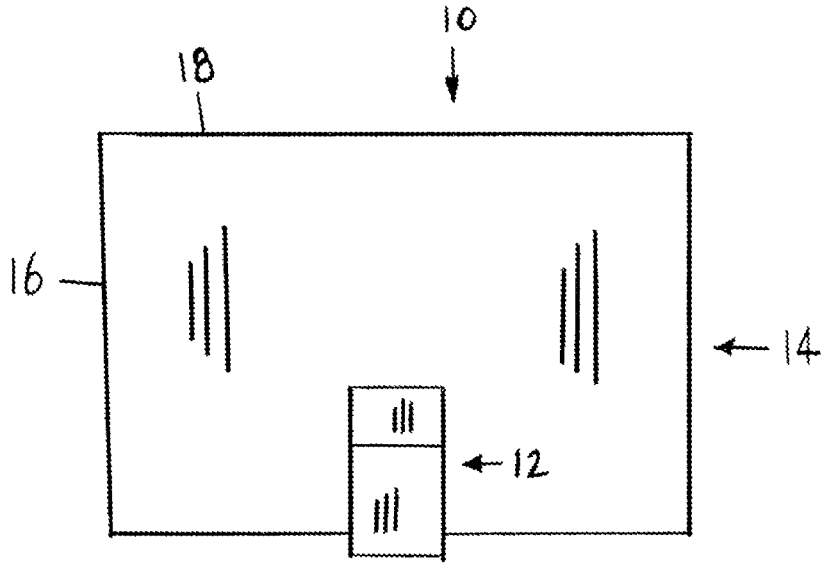
FIG. 1 is a front view of a toilet tank support constructed according to the present disclosure.

Referring now to the drawings, wherein like numbers refer to like items, number 10 identifies a preferred embodiment of a toilet tank support constructed according to the present disclosure. Referring now to FIG. 1, the toilet tank support 10 is shown to comprise a bracket member 12 and a spacer member 14. The spacer member 14 is a generally rectangular element having a height 16 and a length 18. As will be explained further herein, the spacer element 14 also has a width that is used to span the gap or space that exists between a toilet tank (not shown) and a wall (also not shown). The spacer member 14 is adapted to receive the bracket member 12 and the bracket member 12 is adapted to be placed or hooked onto a toilet tank. The bracket member 12 and the spacer member 14 may be constructed of a material that is resistant to mold and mildew or may be coated with a coating that is resistant to mold and mildew.

Figure 2:
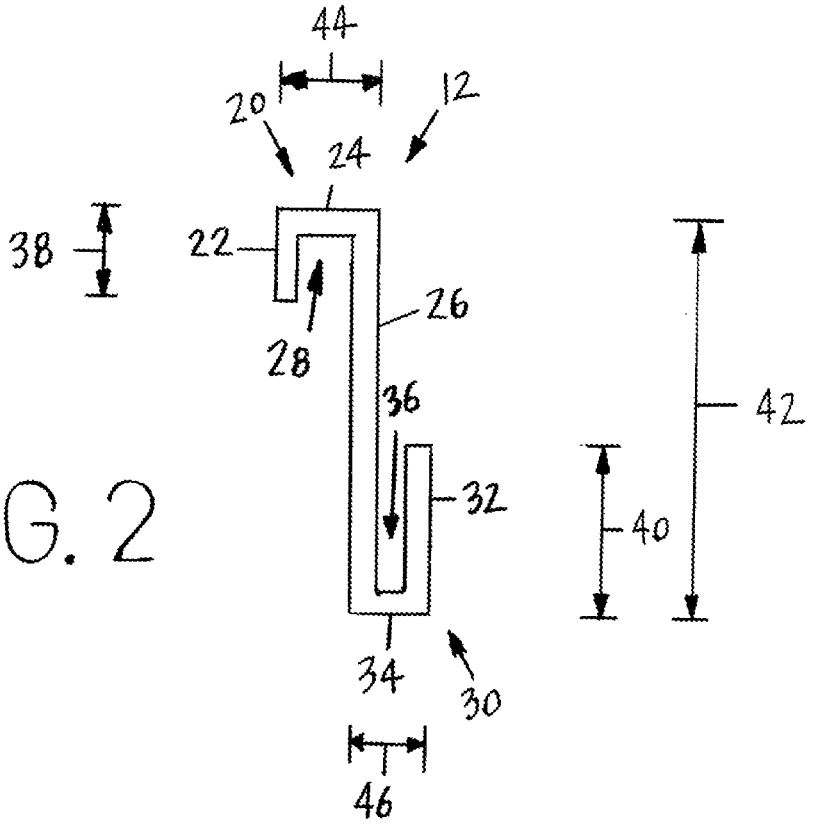
FIG. 2 is a side view of a bracket member that forms part of the toilet tank support constructed according to the present disclosure.

FIG. 2 illustrates a side view of the bracket member 12. The bracket member 12 comprises an upper hook portion 20 having a front leg portion 22, an upper horizontal portion 24, and a vertical section or member 26. The front leg portion 22, the upper horizontal portion 24, and the vertical member 26 form an upper hook portion channel 28. The bracket member 12 also has a lower hook portion 30. The lower hook portion 30 has a back leg portion 32 and a lower horizontal portion 34 connected to the vertical member 26. The back leg portion 32, the lower horizontal portion 34, and the vertical member 26 form a lower hook portion channel 36. The front leg portion 22 has a length 38 and the back leg portion 32 has a length 40. The length 40 of the back leg portion 32 is generally greater than the length 38 of the front leg portion 22. However, it is possible that the lengths 38 and 40 may be the same. Further, the vertical member 26 has a length 42 and the length 42 is typically greater than the lengths 38 and 40. By way of example only, the length 38 may be one-half inch, the length 40 may be one and one-half inches, and the length 42 may be two inches. However, other dimensions for the lengths 38, 40, and 42 are possible depending upon the application. The upper horizontal portion 24 has a length 44. The lower horizontal portion 34 has a length 46. Generally, the length 44 is greater than the length 46. Again, by way of example only, the length 44 may be one-half inch and the length 46 may be one-eighth inch. The bracket member 12 may be constructed of any suitable plastic.

Figure 3:
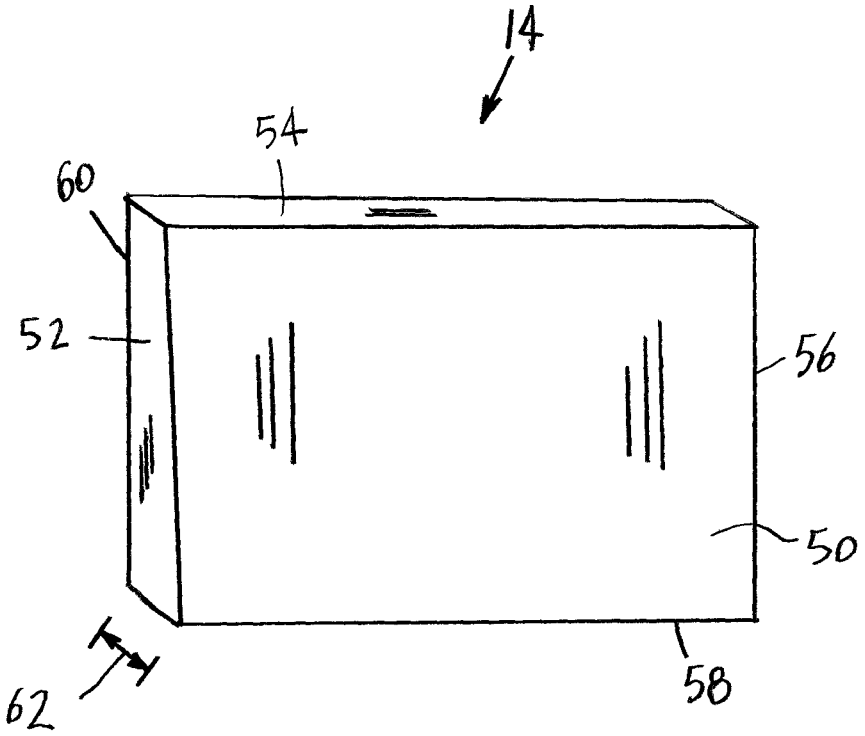
FIG. 3 is a perspective view of a spacer member that forms part of the toilet tank support constructed according to the present disclosure.

With reference now to FIG. 3, a perspective view of the spacer member 14 is shown. The spacer member 14 has a front toilet tank engaging surface 50, a left side 52, an upper side 54, a right side 56, a lower side 58, and a rear wall engaging surface 60. The spacer member 14 also has a width 62. The width 62 of the spacer member 14 is used to span or fill a gap between a toilet tank and a wall, which will be explained in detail further herein. For purposes of example only, the width 62 of the spacer member 14 may be one-half inch, one inch, one and one-half inches, and two inches. Although the spacer member 14 is depicted as being generally rectangular in shape and construction, it is contemplated that the spacer member 14 may be any shape that can span a gap with such other shapes being, by way of example only, square, triangular, circular, and oval. The spacer member 14 may be constructed of any suitable plastic. Also, the spacer member 14 may be solid or the spacer member 14 may be a hollow construction with reinforcing ribs inside the spacer member 14 to provide strength to the spacer member 14.

Figure 4:
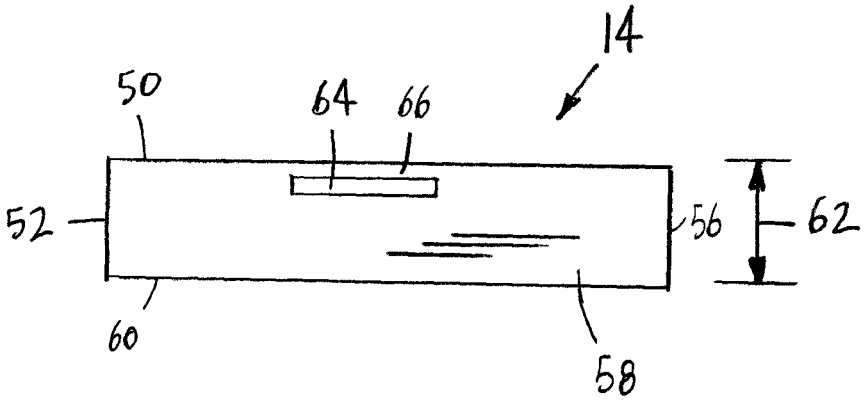
FIG. 4 is a bottom view of the spacer member constructed according to the present disclosure.

FIG. 4 illustrates a bottom view of the spacer member 14. The spacer member 14 has the front toilet tank engaging surface 50, the left side 52, the right side 56, the lower side 58, and the rear wall engaging surface 60. The lower side 58 has a slot, an aperture, or an opening 64 formed therein. The opening 64 is sized and shaped to receive the back leg portion 32 (FIG. 2) of the bracket member 12. The opening 64 is generally centrally located along the lower side 58. However, the opening 64 may be positioned anywhere along the lower side 58. It is also possible that more than one opening 64 may be formed in the lower side 58. A set back space 66 is provided between the opening 64 and the front toilet tank engaging surface 50 with the set back space 66 being able to be placed within the lower hook portion channel 36 (FIG. 2). In essence, the opening 64 is used to receive the back leg portion 32 to connect or hook the spacer member 14 to the bracket member 12. This connection holds the spacer member 14 in place.

Figure 5:
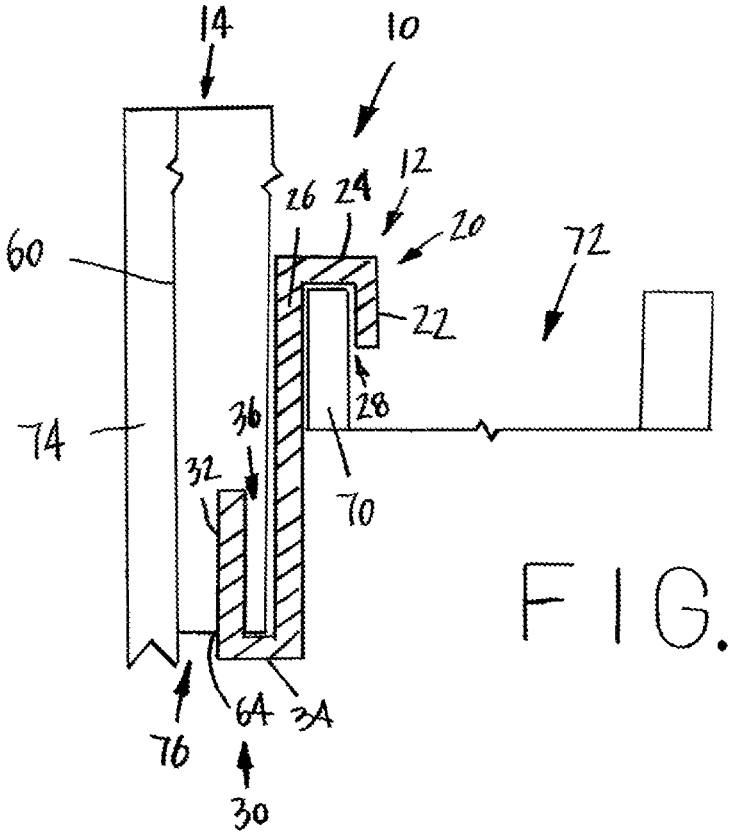
FIG. 5 is a partial cross-sectional view of the toilet tank support being hooked onto a toilet tank and the spacer member being positioned between the toilet tank and a wall to span or fill a gap between the toilet tank and the wall.

With reference now to FIG. 5, a partial cross-sectional view of the toilet tank support 10 is shown with the bracket member 12 of the support 10 being hooked onto a rear wall 70 of a toilet tank 72 and the spacer member 14 being positioned between the rear wall 70 and a wall 74 to span or fill a gap 76 between the toilet tank 70 and the wall 74. The toilet tank 72 may have a lid or cover (not shown) that has been removed for purposes of clarity. The bracket member 12 is shown having the front leg portion 22, the upper horizontal portion 24, and the vertical section or member 26. The front leg portion 22, the upper horizontal portion 24, and the vertical member 26 form the upper hook portion channel 28. The upper hook portion channel 28 of the upper hook portion 20 is used to receive the rear wall 70 of the toilet tank 72. In this manner, the bracket member 12 is hooked onto the rear wall 70 of the toilet tank 72 and held in place. The bracket member 12 also has the lower hook portion 30. The lower hook portion 30 has the back leg portion 32 and the lower horizontal portion 34 connected to the vertical member 26. The back leg portion 32, the lower horizontal portion, and the vertical member 26 form the lower hook portion channel 36. The lower hook portion channel 36 is used to receive the spacer member 14 through the opening 64. In this manner, the spacer member 14 is hooked onto or secured to the bracket member 12 and held in place. The rear wall engaging surface 60 of the spacer member 14 has a large amount of surface area for engaging the wall 74. This prevents the toilet tank support 10 from being improperly installed and from moving or shifting during use. Further, there is no need to use any fasteners to hold or secure the spacer member 14 to the wall 74.

In operation, the toilet tank support 10 is assembled by inserting the bracket member 12 into the spacer member 14. This is accomplished by inserting the back leg portion 32 into the opening 64 provided in the lower side 58 of the spacer member 14. The lower hook portion channel 36 is used to capture and hold the spacer member 14. Once assembled, the toilet tank support 10 is hooked onto the rear wall 70 of the toilet tank 72 by use of the upper hook portion channel 28 of the bracket member 12. The spacer member 14 then fills up the space or the gap 76 between the rear wall 70 of the toilet tank 70 and the wall 74. If an individual rests against the toilet tank 72, any movement of the toilet tank 72 will be prevented by use of the toilet tank support 10. Since the toilet tank 72 is prevented from moving by use of the support 10, there will be no damage to the toilet tank 72 or to the wall 74.

Figure 6:
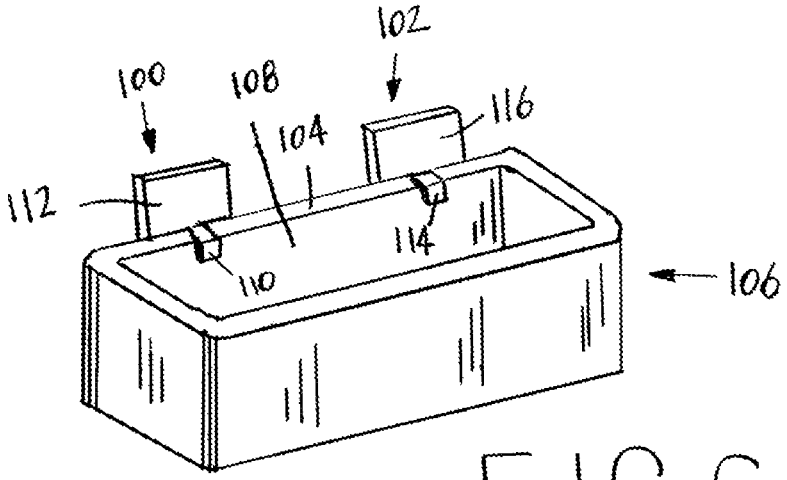
FIG. 6 is a partial perspective view of a pair of toilet tank supports constructed according to the present disclosure being installed onto a toilet tank.

FIG. 6 depicts a pair of toilet tank supports 100 and 102 being placed on an upper rear edge 104 of a toilet tank 106. The toilet tank 106 has a rear wall 108 having the upper rear edge 104. Again, for sake of clarity a toilet tank lid (not shown) has been removed. The toilet tank support 100 comprises a bracket member 110 and a spacer member 112. The toilet tank support 102 comprises a bracket member 114 and a spacer member 116. The toilet tank supports 100 and 102 are the same as the toilet tank support 10. As can be appreciated, a single toilet tank support 10, 100, or 102 may be positioned on the upper edge 104 of the rear wall 108 of the toilet tank 106 or more than two of the toilet tank supports 10, 100, or 102 may be employed. It is also possible that the spacer members 14, 112, or 116 may be the same length as the upper rear edge 104.

Figure 7:
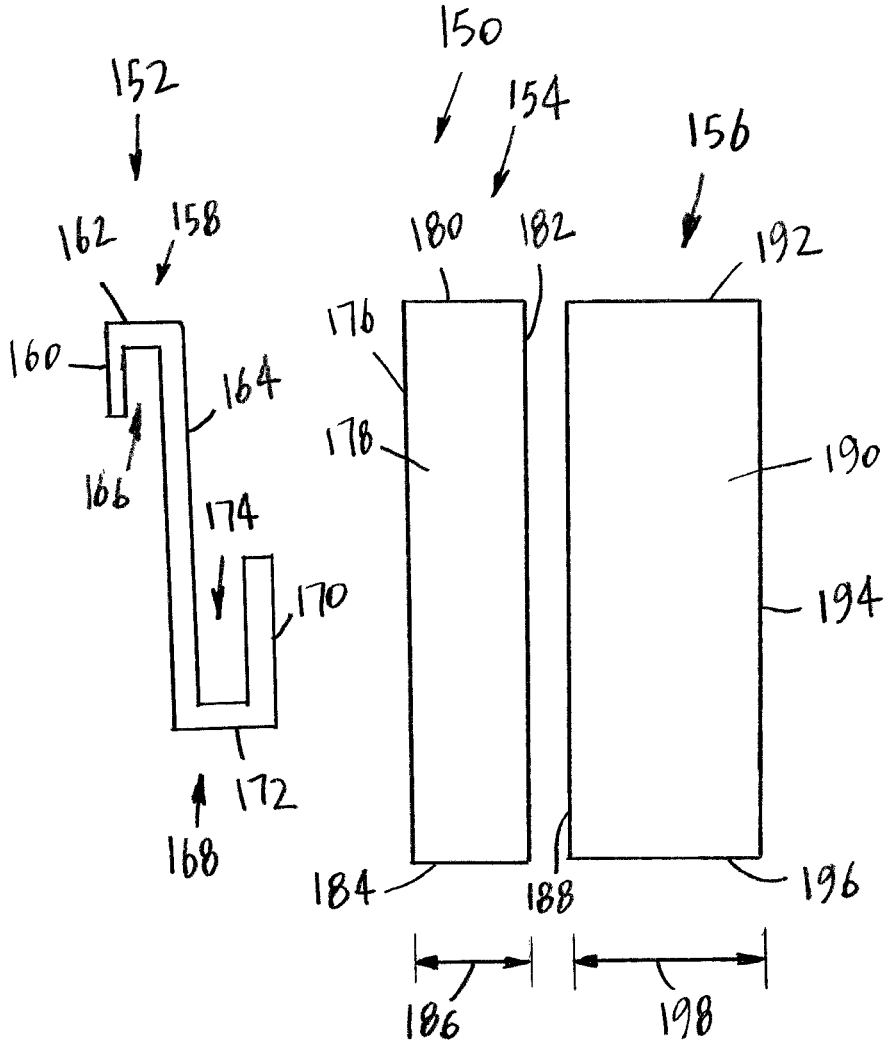
FIG. 7 is a side view of a toilet tank support kit constructed according to the present disclosure.

Referring now to FIG. 7, a toilet tank support kit 150 of the present disclosure is shown. The toilet tank support kit 150 comprises a bracket member 152, a first spacer member 154, and a second spacer member 156. The bracket member 152 comprises an upper hook portion 158 having a front leg portion 160, an upper horizontal portion 162, and a vertical section or member 164. The front leg portion 160, the upper horizontal portion 162, and the vertical member 164 form an upper hook portion channel 166. The bracket member 152 also has a lower hook portion 168. The lower hook portion 168 has a back leg portion 170 and a lower horizontal portion 172 connected to the vertical member 164. The back leg portion 170, the lower horizontal portion 172, and the vertical member 164 form a lower hook portion channel 174. The bracket member 152 may be constructed of any suitable plastic.

The first spacer member 154 comprises a front toilet tank engaging surface 176, a left side 178, an upper side 180, a rear wall engaging surface 182, and a bottom side 184. Although not shown in this particular view, the first spacer member 154 has a right side. Also, not shown in this view, the bottom side 184 has an opening formed therein for receiving the back leg portion 170 of the bracket member 152. The first spacer member 154 also has a width 186. The width 186 of the first spacer member 154 is used to span or fill a gap between a toilet tank and a wall, as has been explained in detail herein. For purposes of example only, the width 186 of the first spacer member 154 may be one inch. The first spacer member 154 may be constructed of any suitable plastic.

The second spacer member 156 comprises a front toilet tank engaging surface 188, a left side 190, an upper side 192, a rear wall engaging surface 194, and a bottom side 196. The second spacer member 156 also has a right side, however, this is not shown in this view. Further, the bottom side 196 has an opening formed therein for receiving the back leg portion 170 of the bracket member 152. The second spacer member 156 has a width 198. The width 198 of the second spacer member 156 is used to span or fill a gap between a toilet tank and a wall, as has been explained in detail herein. For purposes of example only, the width 198 of the second spacer member 156 may be two inches. In essence, the width 198 of the second spacer member 156 is greater than the width 186 of the first spacer member 154. The second spacer member 156 may be constructed of any suitable plastic.

As can be appreciated, the bracket member 152, the first spacer member 154, and the second spacer member 156 form the toilet tank support kit 150. The bracket member 152, the first spacer member 154, and the second spacer member 156 may be packaged together within a single package. In this manner, the kit 150 is used to span various different gaps, such as the gap 76 (FIG. 5) without having to measure or know what the width of the gap 76 is. In particular, an individual can purchase the kit 150 without knowing the size of the gap 76 and use the spacer 154 or 156 which is large enough to fill the gap 76. It is also possible and contemplated that the toilet tank support kit 150 may contain more than two different sized width spacers 152 and 154. For example, the toilet tank support kit 150 may include a third spacer member having a third width which is greater than the widths 186 and 198. By way of example only, the third width may be three inches. Also, the toilet tank support kit 150 may include a fourth spacer member having a fourth width which is greater than the third width and the widths 186 and 198. Again, by way of example only, the fourth width may be four inches. In this manner, the kit 150 may be used to accommodate a gap of up to four inches. It is also possible that the kit 150 may include spacer members having other sized widths. For example, the spacer members may be half sizes such as one-half inch, one and one-half inches, two and one-half inches, three and one-half inches, and even four and one-half inches. Other sized widths are possible, such as quarter sized widths. In this manner, various sized gaps may be accommodated for by using the toilet tank kit 150 of the present disclosure without having a need to know the size of the gap prior to purchasing the toilet tank kit 150.

From all that has been said, it will be clear that there has thus been shown and described herein a toilet tank support which fulfills the various objects and advantages sought therefor. It will be apparent to those skilled in the art, however, that many changes, modifications, variations, and other uses and applications of the subject toilet tank support are possible and contemplated. All changes, modifications, variations, and other uses and applications which do not depart from the spirit and scope of the disclosure are deemed to be covered by the disclosure, which is limited only by the claims which follow.

What is claimed is:

1. A toilet tank support comprising:

a bracket member having an upper hook portion, a lower hook portion, and a vertical member, the upper hook portion having a front leg portion and an upper horizontal portion connected to an upper end of the vertical member thereby defining an upper hook portion channel configured to receive an upper edge of a toilet tank, and the lower hook portion having a back leg portion and a lower horizontal portion connected to a lower end of the vertical member thereby defining a lower hook portion channel, wherein the front leg portion has a length, the back leg portion has a length, the vertical member has a length, and the length of the vertical member is greater than the length of the back leg portion; and a rectangular spacer member having a front surface, a left side, an upper side, a right side, a lower side, and a rear surface, and an opening formed in the lower side for receiving therein the back leg portion of the bracket member;

wherein the bracket member receives the spacer member configured to substantially span a gap that exists between the toilet tank and a wall.

2. The toilet tank support of claim 1 wherein the bracket member is constructed of plastic.

3. The toilet tank support of claim 1 wherein the spacer member is constructed of plastic.

4. The toilet tank support of claim 1 wherein the spacer member has a width that substantially spans the gap that exists between the toilet tank and the wall.

5. The toilet tank support of claim 1 wherein the spacer member is square in shape.

6. The toilet tank support of claim 1 wherein the bracket member and the spacer member are constructed of plastic.

7. A toilet tank support comprising:

a bracket member having an upper hook portion, a lower hook portion, and a vertical member, the upper hook portion having a planar front leg portion and an upper horizontal portion connected to an upper end of the vertical member thereby defining an upper hook portion channel configured to receive an upper edge of a toilet tank, and the lower hook portion having a planar back leg portion and a lower horizontal portion connected to a lower end of the vertical member thereby defining a lower hook portion channel, wherein the front leg portion has a length; the back leg portion has a length, the vertical member has a length, and the length of the vertical member is greater than the length of the back leg portion; and a spacer member having a front surface, a lower side, and a rear surface, and a slot formed in the lower side for receiving therein the back leg portion of the bracket member with the spacer member configured to substantially span a gap that exists between the toilet tank and a wall.

8. The toilet tank support of claim 7 wherein the spacer member is constructed of plastic.

9. The toilet tank support of claim 7 wherein the bracket member is constructed of plastic.

10. The toilet tank support of claim 7 wherein the spacer member is rectangular in shape.

11. The toilet tank support of claim 7 wherein the spacer member has a width that substantially spans the gap that exists between the toilet tank and the wall, wherein the bracket member receives either the first spacer or the second spacer configured to substantially span a gap that exists between the toilet tank and a wall.

12. The toilet tank support of claim 7 wherein the spacer member is square in shape.

13. The toilet tank support of claim 7 wherein the bracket member and the spacer member are constructed of plastic.

14. A toilet tank support kit comprising:

a bracket member having an upper hook portion, a lower hook portion, and a vertical member, the upper hook portion having a front leg portion and an upper horizontal portion connected to an upper end of the vertical member thereby defining an upper hook portion channel configured to receive an upper edge of a toilet tank, and the lower hook portion having a back leg portion and a lower horizontal portion connected to a lower end of the vertical member thereby defining a lower hook portion channel, wherein the front leg portion has a length, the back leg portion has a length, the vertical member has a length, and the length of the vertical member is greater than the length of the back leg portion;

a first rectangular spacer member having a front surface, a left side, an upper side, a right side, a lower side, and a rear surface, and an opening formed in the lower side for receiving therein the back leg portion of the bracket member, the first spacer member having a width; and a second rectangular spacer member having a front surface, a left side, an upper side, a right side, a lower side, and a rear surface, and an opening formed in the lower side for receiving the back leg portion of the bracket member, the second spacer member having a width with the width of the second spacer member being greater than the width of the first spacer member.

15. The toilet tank support kit of claim 14 wherein the first spacer member is constructed of plastic.

16. The toilet tank support kit of claim 14 wherein the second spacer member is constructed of plastic.

17. The toilet tank support kit of claim 16 wherein the bracket member, the first spacer member, and the second spacer member are packaged within a single package.

18. The toilet tank support kit of claim 14 wherein the bracket member is constructed of plastic.

19. The toilet tank support kit of claim 14 wherein the bracket member, the first spacer member, and the second spacer member are constructed of plastic.

* * * * *